United States Patent [19]

Okamoto et al.

[11] Patent Number: 4,715,289

[45] Date of Patent: Dec. 29, 1987

[54] APPARATUS FOR CONTROLLING VIBRATION OF VEHICLE

[75] Inventors: Isao Okamoto, Musashino; Motomi Hiraishi, Kudamatsu; Hideo Takai, Hikari; Kenjiro Kasai; Katsuyuki Terada, both of Kudamatsu, all of Japan

[73] Assignees: Japan National Railway; Hitachi, Ltd., both of Tokyo, Japan

[21] Appl. No.: 868,025

[22] Filed: May 29, 1986

[30] Foreign Application Priority Data

May 31, 1985 [JP] Japan ..... 60-116420

[51] Int. Cl.[4] ..... B61F 3/08; B61F 5/24; B61F 5/06

[52] U.S. Cl. ..... 105/199.2; 267/3; 280/6 H; 280/707

[58] Field of Search ..... 280/6 R, 6 H, 707, 6.1, 280/6.11, 702; 105/199.2; 267/3, 6

[56] References Cited

U.S. PATENT DOCUMENTS

| | | | |
|---|---|---|---|
| 3,810,429 | 5/1974 | Kallenbach | 105/199.2 |
| 3,902,691 | 9/1975 | Ott | 105/199.2 |
| 4,069,767 | 1/1978 | Glaze | 105/199.2 |
| 4,245,563 | 1/1981 | Empson | 105/199.2 |
| 4,324,187 | 4/1982 | Sambo | 105/199.2 |
| 4,480,555 | 11/1984 | Shafer et al. | 105/199.2 |
| 4,516,507 | 5/1985 | Dean | 105/199.2 |
| 4,566,718 | 1/1986 | Kanai et al. | 280/707 |
| 4,586,728 | 5/1986 | Takunaga et al. | 280/707 |
| 4,624,477 | 11/1986 | Kumagai et al. | 280/707 |

FOREIGN PATENT DOCUMENTS 2025572 12/1982 United Kingdom .

*Primary Examiner*—Richard A. Bertsch

*Attorney, Agent, or Firm*—Antonelli, Terry & Wands

[57] ABSTRACT

This invention relates to a superior suppressing of vibration in a car body when a vehicle runs on a straight railroad and a curvilinear railroad. The invention is comprised of a fluid pressure-acting mechanism arranged between the car body and the truck along with springs for positively controlling a force acting between the car body and the truck with the supplied pressure fluid, an acceleration detector for detecting an acceleration of the car body, and means for determining a displacement generated relatively between the car body and the truck under a steady acceleration acting against the car body. The invention further comprises a controller for receiving a vibration suppressing control signal as a control input representing a result of detection of the acceleration detector, and for receiving a value corresponding to a relative displacement between the car body and the truck contained in the vibration suppressing control signal as a result of the determination from the means for determining a relative displacement between the car body and the truck. The controller subtracts this value from the vibration suppressing controlling signal and outputs it as a control signal. The invention further includes a fluid control unit for controlling a fluid pressure to be supplied to the fluid pressure-acting mechanism with a control signal output by the controller, wherein vibration caused by a relative displacement generated between the car body and the truck with a steady acceleration acting against the car body can be presented to improve driving comfort.

6 Claims, 7 Drawing Figures

APPARATUS FOR CONTROLLING VIBRATION OF VEHICLE

BACKGROUND OF THE INVENTION

1. Field of the Invention

This invention relates to an apparatus for controlling the vibration of a vehicle.

2. Description of the Prior Art

In a conventional apparatus for controlling the vibration of a vehicle, which is as known from, for example, Japanese Patent Laid-open No. 11954/1980 (corresponding to U.K. Pat. No. 2025572), the vibratory acceleration of a car body is detected, and the result of the detection is compensated so as to reduce the vibration of the car body, and a fluid pressure acting means which is provided between the car body and is operated in accordance with the result of the compensation, i.e. a vibration suppressing instruction to thereby suppress the relative vibration between the car body and truck. The fluid pressure acting means generally consists, when compressed air is used as an operating liquid, of a double-acting air cylinder. An air servo valve is used as a fluid controller which is adapted to control the compressed air supplied to the double-acting air cylinder. The output characteristics of the operational power of the double-acting air cylinder include saturation characteristics so as to secure safety when an abnormal phenomenon occurs due to the erroneous operation of the acceleration detecting means and various types of compensating means or the controllability of various types of control means. The saturation characteristics of the double-acting air cylinder can be obtained by, for example, providing the air servo valve with the pressure-flow rate characteristics shown in FIGS. 1 and 2. An example, in which the lateral vibration of a car body is reduced by the doubled-acting cylinder and control means therefor, will now be described. When a vehicle runs on a curved railroad at a high speed, i.e., at such a speed that causes the surplus centrifugal acceleration to be applied to the car body, the surplus centrifugal acceleration is applied from the car body in the lateral direction toward an outer rail on the curved railroad. Accordingly, in the vibration control unit consisting of the double-acting air cylinder and control means, the acceleration detecting means detects, in accordance with its operational principle, the surplus centrifugal acceleration, which is applied in the lateral direction of the car body, as the centripetal acceleration. The results of the detection by this acceleration detecting means are as shown in FIG. 3. In the results shown in FIG. 3 of the detection by the acceleration detecting means, the acceleration, which causes the car body to be shifted steadily in the lateral direction with respect to the chassis, i.e. a drift component D is shown as the centripetal acceleration $\alpha$ and is the displacement relatively generated between the car body and the truck. Therefore, the double-acting air cylinder which is controlled in accordance with the results of the detection provided by the acceleration detecting means is moved so as to displace the car body toward the outer rail. During this time, the surplus centrifugal acceleration working on the car body is high as compared with the acceleration based on a lateral vibration component occurring while the vehicle runs straight, so that the double-acting air cylinder is operated so as to move the car body to the side of the outer rail up to the limit of the saturation characteristics thereof. Consequently, the car body is displaced to the side of the outer rail due to the operational force of the double-acting air cylinder and the surplus centrifugal acceleration to be pressed against a lateral movement stopper which is provided so as to restrict the lateral movement of the car body with respect to the truck in a predetermined range. When the car body is in this condition, the double-acting air cylinder is in a saturation region, and the vibration-reducing functions thereof do not work. Moreover, since the car body is pressed against the lateral movement stopper, the functions of the double-acting air cylinder of reducing the lateral vibration between the car body and truck lower. In addition, there is the possibility that the degree of comfort of a ride on the car body is impaired due to the impulsive lateral acceleration based on the vibratory force transmitted from the railroad to the car body via the truck.

When the vehicle runs on a curved railroad at a high speed, a vertical drift component due to the rolling of the car body occurs in the vertical vibration thereof, so that the same problems mentioned above occur.

Various measures for eliminating such problems may be imagined, which include a measure in which the results of the detection carried out by the car body acceleration detecting means are passed through a high-pass filter and then used for a control operation. However, the variations of these results have an influence even upon the control characteristics based on the results of the detection of regular vibratory acceleration, and good results cannot actually be obtained.

SUMMARY OF THE INVENTION

An object of the present invention is to provide an apparatus for controlling the vibration of a vehicle, which is capable of reducing the vibration of a car body when the vehicle runs both straight and along a curve, and thereby improving the degree of comfort of a ride on the vehicle.

The present invention provides according to an embodiment thereof an apparatus for controlling the vibration of a vehicle, comprising a truck, a car body supported on the truck via springs, a fluid pressure acting mechanism provided between the truck and car body along with said springs and adapted to control the forces acting between the car body and the truck with a pressure fluid, an acceleration detector for detecting the acceleration of the car body, a means for determining a displacement relatively generated between the car body and truck due to the steady acceleration working on the car body, a fluid controller for controlling the pressure fluid supplied to the fluid pressure acting mechanism, and a controller adapted to receive a control input as the result of the detection carried out by the acceleration detector to generate a vibration suppressing control signal. The controller calculates a value, corresponding to the mentioned displacement contained in the vibration suppressing control signal on the basis of the result of an operation of the displacement-determining means, subtracts the resultant value from the vibration suppressing control signal and thereby obtains a control signal. This control signal is output to the fluid controller.

The above and other objects as well as the advantageous features of the invention will become apparent from the following description of the preferred embodiments taken in conjunction with the accompanying drawings.

DESCRIPTION OF THE PREFERRED EMBODIMENTS

The present invention will now be described on the basis of an embodiment shown in FIGS. 4, 5 and 6 and another embodiment shown in FIG. 7.

Figure 1:
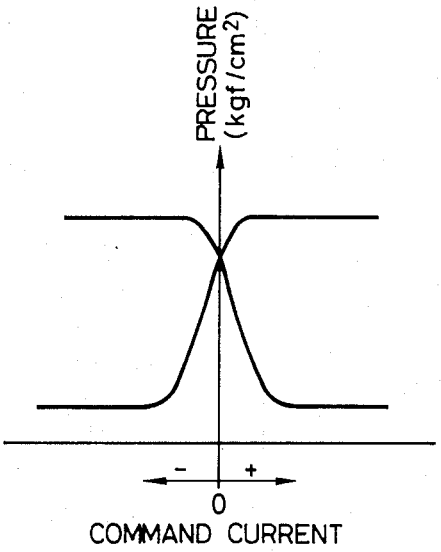
FIG. 1 is a graph showing the pressure characteristics of the air servo valve with respect to a command value.
Figure 2:
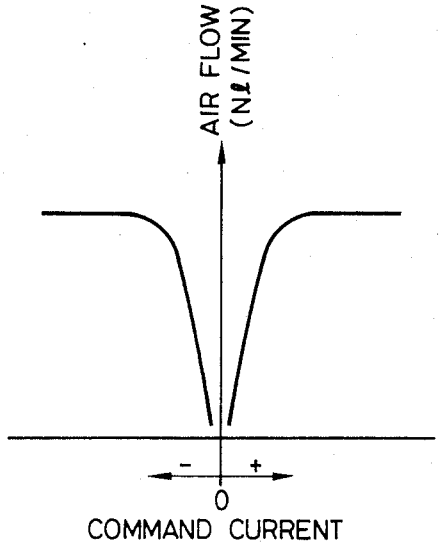
FIG. 2 is a graph showing the flow rate characteristics of the air servo valve with respect to a command value.
Figure 3:
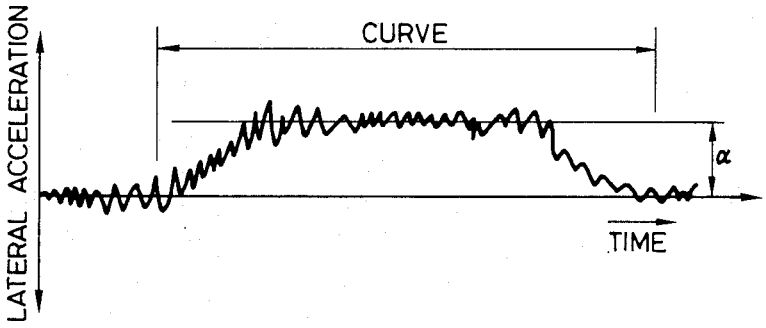
FIG. 3 is a graph showing the waveform of a signal detected by the acceleration detecting means and representative of the lateral acceleration of the car body.
Figure 4:
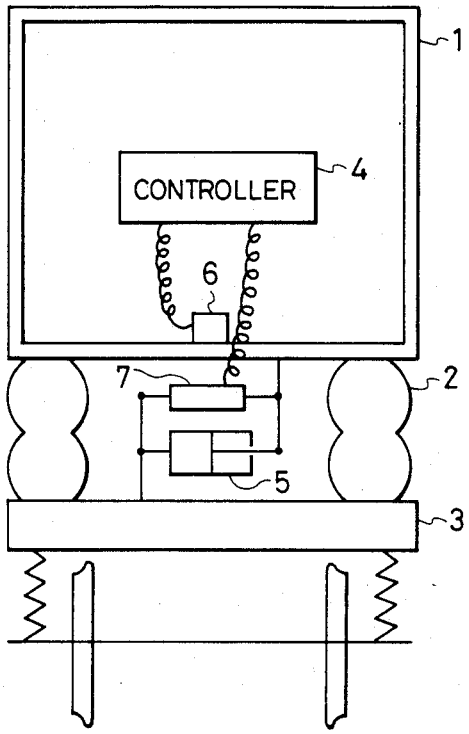
FIG. 4 is a front elevation of an embodiment of the apparatus for controlling the vibration of a vehicle according to the present invention.
Figure 5:
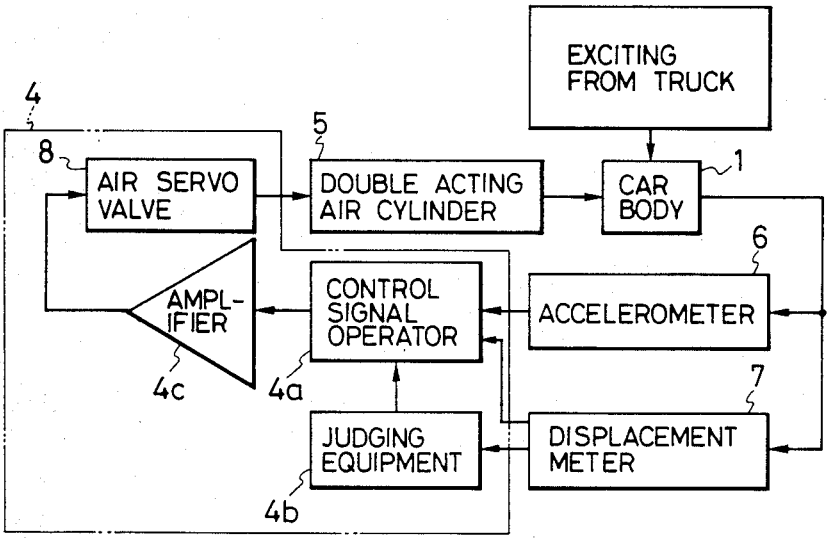
FIG. 5 is a block diagram of a control system in the embodiment of FIG. 4.
Figure 6:
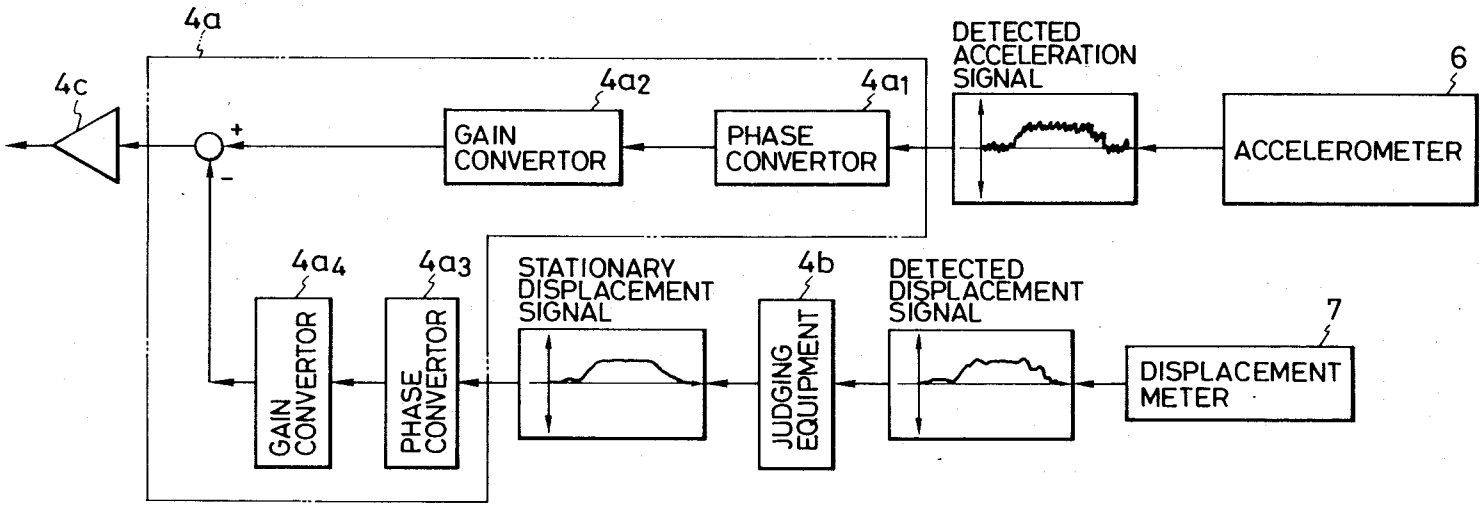
FIG. 6 is a block diagram of a control signal computing unit in the system of FIG. 5.

Referring to FIGS. 4, 5 and 6, reference numeral 1 denotes a car body supported via air springs 2 on a truck 3, and 5 a double-acting air cylinder provided between the car body 1 and truck 3, serving as a fluid-acting means, and joined at one end thereof to the car body 1 and at the other end thereof to the truck 3 so that the double-acting air cylinder 5 is moved in the lateral direction of the car body 1. The double-acting air cylinder 5 is adapted to suppress the relative displacement, which occurs in the lateral direction of the car body, between the car body 1 and truck 3, and directly control the extending and contracting actions thereof and thereby reduce the vibration of the car body. Reference numeral 7 denotes a displacement meter provided in opposition of the double-acting air cylinder 5 and adapted to detect the relative displacement of the car body 1 and truck 3 in the lateral direction of the car body. Reference numeral 6 represents an accelerometer provided on the car body 1 and is adapted to detect the vibratory acceleration of the car body 1. Reference numeral 4 represents a controller adapted to receive as control inputs the results of detection from the accelerometer 6 and displacement meter 7, and output a signal for controlling the double-acting air cylinder 5. Reference numeral 8 represents an air servo valve adapted to receive a control signal from the controller 4 and control in accordance with this control signal the compressed air, an operating fluid supplied to the double-acting cylinder. The air servo valve 8 is a member corresponding to a fluid controller adapted to control the operating fluid. The construction of the controller 4 will now be described in detail. The controller 4 consists as shown in FIG. 5 of a control signal computing unit 4*a* adapted to compensate for the results of detection from the accelerometer 6 and displacement meter 7, compute an optimum control signal for controlling the double-acting air cylinder 5 and output a signal to the air servo valve 8. Judging equipment 4*b* is adapted to output the results of detection from the displacement meter 7, i.e. a signal of the detected displacement after subtracting a high-frequency component of not less than a predetermined frequency from this result, or to compare a predetermined value, i.e. an allowable value of lateral displacement between the car body 1 and truck 3 with the above result of detection and then make a judgement. Amplifier 4*c* is adapted to amplify the optimum control signal output from the control signal computing unit 4*a*. As shown in FIG. 6, the control signal computing unit 4*a* consists of a phase converter $4a_1$ adapted to compensate for the phase of the signal of the acceleration detected by and output from the accelerometer 6, a gain converter $4a_2$ adapted to change a gain for each frequency band of the signal of the detected acceleration, a phase converter $4a_3$ adapted to compensate for the phase of the steady displacement signal output from the judging equipment 4*b*, and a gain converter $4a_4$ adapted to change the gain of the steady displacement signal. The accelerometer 6, phase converter $4a_3$ and gain converters form an acceleration feedback circuit. The control signal computing unit 4*a* has the functions of converting the code of the steady displacement signal, i.e. a drift suppressing control signal, which is obtained by compensating for the signal of detected displacement output from the gain converter $4a_4$, with respect to the vibration suppressing control signal obtained by compensating the signal of detected acceleration output from the gain converter $4a_2$, and adding the resultant signal. Namely, the control signal computing unit 4*a* has the functions of subtracting th drift suppressing control signal portion from the vibration suppressing control signal. Based on this subtraction, the valve output from the control signal computing unit 4 becomes that of the optimum control signal. A signal of displacement detected by the displacement meter 7 is compensated by the judging equipment 4*b*, i.e. an element having the functions of a low-pass filter, to obtain a steady displacement signal. This steady displacement signal is regarded as a drift component with respect to the truck for the car body 1, and is compensated by the phase coverter $4a_3$ and gain coverter $4a_4$. The resultant signal is used as a drift suppressing control signal as mentioned above.

When the vehicle runs on a straight railroad with a vibration control apparatus of the above-described described construction attached thereto, the relative lateral displacement of the car body 1 and truck 3, which is detected by the displacement meter 7, is at a steady zero level. Accordingly, the result of detection, i.e. a signal of detected acceleration from the accelerometer 6 is compensated by the control signal computing unit 4*a*, and a vibration suppressing control signal is output. This vibration suppressing control signal is amplified by the amplifier 4*c* and output to the air servo valve 8. By this vibration suppressing control signal, air servo valve 8 controls by this the compressed air supplied to the doubled-acting air cylinder 5, to actuate the same air cylinder. In accordance with the operation of the double-acting air cylinder 5, the relative lateral displacement of the car body 1 and truck 3 is controlled to reduced the vibration of the car body 1. Since the signal of detected displacement is at a zero level as mentioned above, a drift suppressing control signal is not output.

When the vehicle runs on a curved railroad at a high speed, a large surplus centrifugal acceleration is applied to the lateral direction of the vehicle body 1. As a result, the relative, lateral, steady displacement of the car body 1 and truck 3 occurs. Therefore, the displacement of the car body 1 and truck 3 is detected by the displacement meter 7, and a signal representative of this displacement is compensated by the judging equipment 4b, phase converter $4a_3$ and gain converter $4a_4$ to obtain a drift suppressing control signal. During this time, a signal of detected acceleration is output from the accelerator. This signal of detected acceleration is compensated by the phase converter $4a_a$ and gain converter $4a_2$, and a vibration suppressing control signal is output. The vibration suppressing control signal contains a drift component which corresponds to the surplus centrifugal force applied to the car body 1. Accordingly, when the drift suppressing control signal is subtracted from the vibration suppressing control signal, the drift component can be offset, and an optimum control signal can be obtained. The optimum control signal thus obtained is output to the air servo valve 8 through the amplifier 4c to control the double-acting air cylinder 5. Since the optimum control signal is obtained through the above-mentioned drift component-eliminating step, an operation for suppressing the vibration of the car body 1 can be carried out by the double-acting air cylinder with a drift, which occurs due to the surplus centrifugal force applied to the car body 1, in a reduced state.

According to such an arrangement, the double-acting air cylinder 5 can be controlled by an optimum control signal, from which a negative influence of the surplus centrifugal force of the car body 1, which occurs while the vehicle runs on a curved railroad at a high speed, i.e. a drift component, has been eliminated. The double acting air cylinder 5 is not operated in a contracted state up to the limit of saturation characteristics, THe apparatus can fully display its vibration-reducing functions. When the double-acting cylinder is extended or contracted, the car body 1 does not contact the outer rail side lateral movement stopper, so that the deterioration, which occurs due to the interference of the car body 1 with the lateral movement stopper, of the vibration reducing functions of this apparatus can be prevented.

The judging equipment 4b has the functions of comparing the level of allowable lateral displacement with that of a signal of detected displacement from the displacement meter 7 and making a judgment. It may be constructed so that is forms a displacement feedback circuit adapted to output a drift suppressing control sign 1 alone as an optimum control signal when the level of the signal of detected displacement is higher than that of the allowable displacement, to thereby control the double-acting air cylinder 5 during the displacement feedback control operation. During this time, the lateral movement of the car body 1 is suppressed by the doubled-acting air cylinder 5, so that the impulsive vibration, which occurs due to the interference of the car body 1 with a lateral movement stopper, can be prevented.

Figure 7:
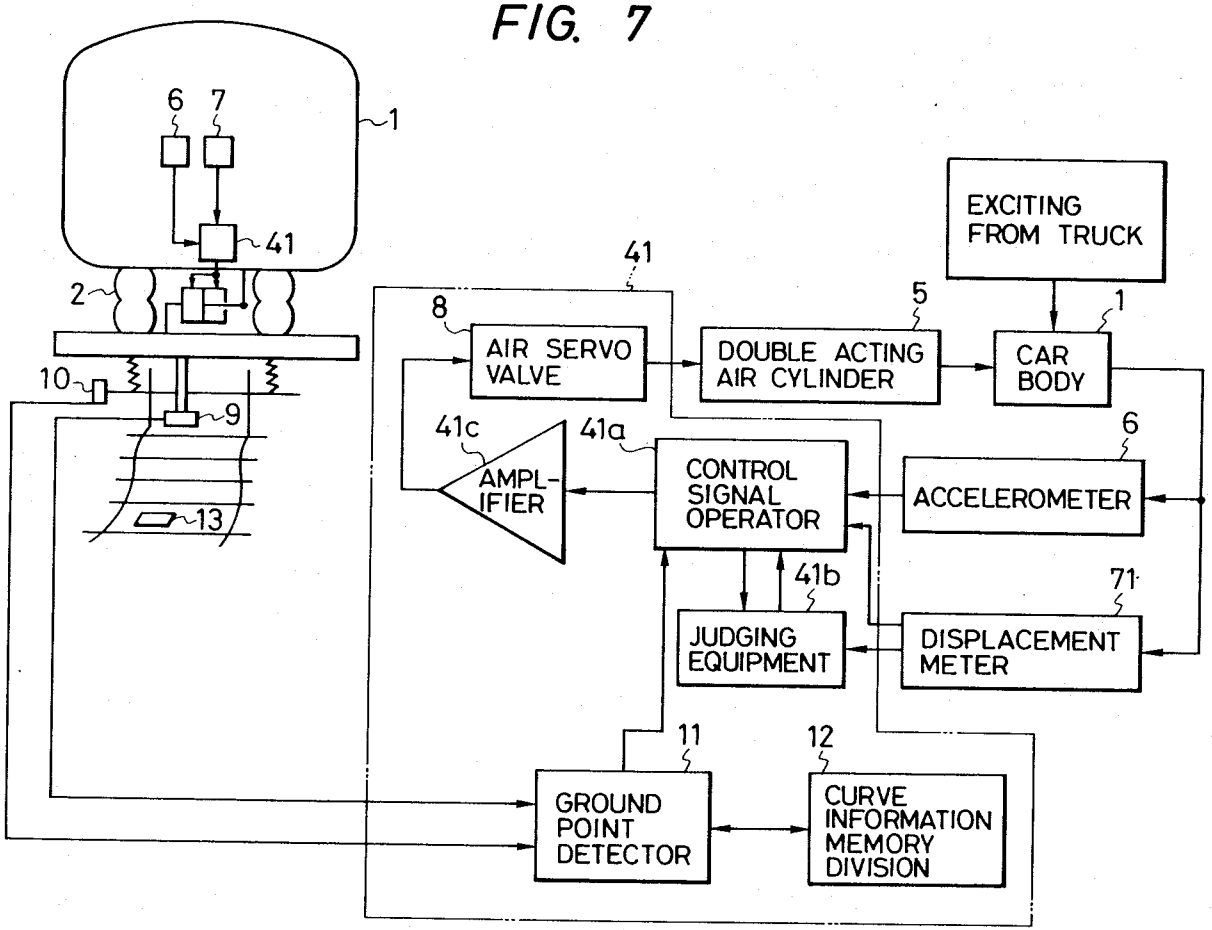
FIG. 7 is a block diagram of a control system showing another embodiment of the apparatus for controlling the vibration of a vehicle according to the present invention.

Referring to FIG. 7, the reference numerals identical with those used for the above embodiment designate the same members. Reference numeral 13 denotes a ground side coil provided on a railroad, 9 a car side coil adapted to detect the position of the ground side coil 13, 10 a detector for detecting the running speed of a vehicle, 11 a ground point detector adapted to receive as inputs a signal representative of the position of the ground side coil 13 output from the car side coil 9 and a signal representative of the running speed of the vehicle output from the speed detector 10, to determine the point at which the vehicle actually runs. A memory device 12 stores various curved railroad information including the degree of irregularity of a point on an irregular ground in a railroad on which the vehicle runs, and a radius of curvature, length and cant of a curved railroad. When the result of detection of a point at which the vehicle actually runs is input from the ground point detector 11 into the memory device 12, the information on the ground point is output therefrom. The controller 41 in this embodiment consists of the members previously mentioned. The control signal computing unit 41a has the functions of computing a drift suppressing control signal on the basis of various information on the railroad and the running speed, which are input thereto from the curved railroad information memory device 12 and speed detector 10 in addition to the acceleration feedback circuit in the control signal computing unit 4a through the ground point detector 11. If a running speed V of the vehicle on a curved railroad, a radius of curvature R of the curved railroad and the cant C of the curved railroad are given, a drift component D applied to the car body 1 can be obtained by computation in accordance with the following equation:

$$\text{Drift component } D=(V^2/g^R)-(C/B) \quad (1)$$

wherein V is a running speed; g the gravity acceleration; R a radius of curvature of a curved railroad; B a distance between the left and right wheels of the vehicle; and C the cant.

Accordingly, if the drift component D expressed by the above equation (1) is added with its code reversed to the output from the acceleration feedback circuit, which consists of the accelerometer 6, an optimum control signal can also be output from a control signal computing unit 41a in this embodiment in the same manner as in the control signal computing unit 4a in the previous embodiment. In the second embodiment, a displacement meter 71 and judging equipment 41b are provided so as to compare the level of relative lateral displacement of the car body 1 and truck with a set level and make a judgment, and to monitor the relative displacement so that the level thereof does not become higher than the set level. The distance B between the left and right wheels in the above equation (1) is constant in each vehicle, and it can be input in advance. Therefore, it is unnecessary that the distance B be input from the curved railroad information memory device 12.

According to this arrangement, a ground point at which the vehicle enters a curved railroad is detected by the ground point detector 11. The information required for the calculation of the equation (1) is then output from the curved railroad information memory device 12 to the control signal computing unit 41a through the ground point detector 11. In the control signal computing unit 41a, this information is computed by using the equation (1) to determine the drift component D, which is added as a drift suppressing control signal with its code reversed to the vibration suppressing control signal output from the acceleration feedback circuit. Namely, the control signal computing unit 41a is formed so that the drift component D, i.e. a drift suppressing control signal, is subtracted from the vibration suppressing control signal, which is obtained by making compensation for the signal of detected acceleration from the accelerometer 6 by the phase converter $4a_1$ and gain converter $4a_2$, and which is output from the acceleration feedback circuit, to output an optimum control signal. Therefore, according to this embodiment, the double-acting air cylinder 5 is not operated up to the limit of the saturation characteristics. In addition, the deterioration of the vibration reducing functions, which occurs due to the interference of the car body 1 with the lateral movement stopper, can be prevented. In addition this embodiment has the following advantages: various kinds of information can be input into the controller 41 in advance from the ground point detector 11 and curved railroad information memory device 12 before the above-mentioned control operations have become necessary to be carried out. This enables the delay of an operation of the control system to be prevented, and an accurate and excellent control operation to be carried out. Since the information given to the controller 41 consists of suitable theoretical information calculated beforehand, the reliability of the apparatus can be improved as compared with the apparatus in the previous embodiment in which the signal of displacement detected by the displacement meter 7 is used.

Each of the above embodiments is directed to a vibration control apparatus in which the relative lateral displacement of a car body and a truck is detected to carry out a displacement feedback control operation on the basis of the result of the detection, or a vibration control apparatus in which a lateral drift component between a car body and a truck is determined on the basis of various information on a railroad to subject the drift component to subtraction and thereby suppress the vibration. In each of these embodiments, the prevention of the negative influence of the relative lateral displacement between a car body and a truck is described. When a vehicle runs on a curved road, the surplus centrifugal acceleration is applied to the car body. The center of gravity of the car body is in a vertically intermediate portion thereof. Accordingly, the car body rolls. When the car body rolls, the vertical displacement occurs in the fluid pressure-acting means, which are provided on the left and right sides of a space between the car body and truck so that these means are vertically moved. Therefore, the rolling of the car body has a negtive influence upon these fluid pressure-acting means as well which are provided so as to vertically extend. Even in these vertically set fluid pressure-acting means, the displacement, which occurs due to the rolling of the car body, the car body and truck can be detected and it can be controlled in the same manner as in the above embodiments to reduce the negative influence referred to above.

According to the present invention described above, the vibration of a car body can be reduced excellently without any troubles when the vehicle runs on a curved railroad at a high speed. Accordingly, the vibration of a car body can be reduced both when the vehicle runs on a straight railroad and when the vehicle runs on a curved railroad. This enables the degree of comfort of a ride on the vehicle to be much improved.

What is claimed is:

1. An apparatus for controlling the vibration of a vehicle, comprising:

a truck;

a car body;

springs for supporting said car body on said truck;

a fluid pressure-acting mechanism arranged between said truck and said car body for controlling forces acting between said car body and said truck with a pressure fluid;

an acceleration detector for detecting acceleration of said car body;

means for determining displacement relatively generated between said car body and said truck due to a steady acceleration acting against said car body;

a fluid controller for controlling said pressure fluid supplied to said fluid pressure-acting mechanism; and a controller for generating a vibration suppressing control signal based on an output from said acceleration detector, for calculating a displacement value, corresponding to said displacement relatively generated between said car body and said truck contained in said vibration suppressing control signal based on an output from said means for determining displacement generated relatively between said car body and said truck and for subtracting said displacement value from said vibration suppressing control signal to provide a control signal for controlling said fluid controller.

2. An apparatus for controlling the vibration of a vehicle according to claim 1, wherein said means for determining a displacement generated relatively between said car body and said truck consists of a detector adapted to detect the relative displacement of said car body and said truck.

3. An apparatus for controlling the vibration of a vehicle according to claim 1, wherein said means for determining a displacement generated relatively between said car body comprises:

a detector adapted to detect the relative displacement of said car body and said truck, said controller including an acceleration feedback circuit adapted to receive as a control input the results of the detection carried out by said acceleration detector to carry out a first feedback control operation, and a displacement feedback circuit adapted to receive as an input the result of the detection carried out by said displacement detector to carry out a second feedback control operation.

4. An apparatus for controlling the vibration of a vehicle according to claim 1, wherein said means for determining displacement generated relatively between said car body and said truck comprises:

a curved railroad information output device for outputting curved railroad information of a curved railroad on which said vehicle runs, a speed detector for detecting and outputting a running speed of said vehicle, and a displacement calculation device for calculating displacement generated relatively between said car body and said truck based on said curved railroad information output from said curved railroad information output device and said running speed output from said spaced detector unit.

5. An apparatus for controlling the vibration of a vehicle comprising:

a truck;

a car body;

springs for supporting said car body on said truck;

a double-acting cylinder arranged between said truck and said car body;

an acceleration detector for detecting an acceleration of said car body;

means for determining a displacement generated relatively between said car body and said truck due to a steady acceleration acting against said car body;

a servo-valve for controlling operating fluid supplied to said double-acting cylinder; and a controller for receiving a vibration suppressing control signal for suppressing the vibration of said car body based on an output from said acceleration detector and for calculating a displacement value corresponding to a displacement generated relatively between said car body and said truck contained in said vibration suppressing control signal based on an output from said means for calculating a displacement generated relatively between said car body and said truck, and for subtracting said displacement value from said vibration suppressing control signal to provide a control signal for controlling said servo-valve.

6. An apparatus for controlling the vibration of a railway vehicle comprising:

two trucks;

a car body supported on said two trucks;

springs arranged between each of said trucks and said car body for supporting said car body on said trucks;

fluid pressure-acting mechanisms arranged between each of said trucks and said car body;

an acceleration detector for detecting an acceleration of said body;

means for determining displacement generated relatively between said car body and said trucks with a steady acceleration acting against said car body;

a fluid controller for controlling pressure fluid to be supplied to said fluid pressure-acting mechanism; and a controller for calculating a vibration suppressing control signal based on an output from said acceleration detector for calculating a displacement value corresponding to a displacement generated relatively between said car body and said trucks contained in said vibration suppressing control signal based on an output from said means for determining a relative displacement between said car body and said trucks, and for subtracting said displacement value from said vibration suppressing control signal to provide a control signal for controlling said fluid controller.

* * * * *